US006533251B1

(12) United States Patent
Abbaticchio

(10) Patent No.: US 6,533,251 B1
(45) Date of Patent: Mar. 18, 2003

(54) MODULAR RAILING SYSTEM

(76) Inventor: Michael Abbaticchio, 1607 Comus Rd., Clarksburg, MD (US) 20871

( * ) Notice: Subject to any disclaimer, the term of this patent is extended or adjusted under 35 U.S.C. 154(b) by 0 days.

(21) Appl. No.: 09/487,300

(22) Filed: Jan. 19, 2000

Related U.S. Application Data

(60) Provisional application No. 60/116,590, filed on Jan. 20, 1999.

(51) Int. Cl.[7] ..... E04H 17/14; E04F 11/18

(52) U.S. Cl. ..... 256/65.15; 256/65.16; 256/65.01; 256/59

(58) Field of Search ..... 256/6, 65, 67, 256/59, 65.15

(56) References Cited

U.S. PATENT DOCUMENTS 3,842,564 A * 10/1974 Brown ..... 256/65 X
3,982,735 A * 9/1976 Fornells ..... 256/59
4,078,773 A * 3/1978 Ellingson, Jr. ..... 256/65
4,557,467 A * 12/1985 Lin ..... 256/59
4,869,034 A * 9/1989 Hammond ..... 52/184
4,930,754 A * 6/1990 Caron et al. ..... 256/65.15
5,165,643 A * 11/1992 Shreiner ..... 256/59 X
5,273,258 A * 12/1993 Bedics ..... 256/59
5,288,048 A * 2/1994 Shreiner ..... 248/251
5,370,368 A * 12/1994 Terrels et al. ..... 256/65.15 X
5,657,968 A * 8/1997 Marsden ..... 256/65
5,738,588 A * 4/1998 Esser ..... 256/65 X
5,992,828 A * 11/1999 Burdick ..... 256/10

* cited by examiner

*Primary Examiner*—Lynne H. Browne
*Assistant Examiner*—Ernesto Garcia
(74) *Attorney, Agent, or Firm*—Dickinson Wright PLLC

(57) ABSTRACT

The present invention relates to a modular railing system for use as a handrail or bumper rail that has a substantially continuous and smooth exterior surface that is easily cleaned and helps prevent the collection and accumulation of surface contaminants. The system is comprised of multiple modular sections which can be secured together using internal connectors which eliminates the need for any exposed mechanical fasteners. The sections can be made straight or curved to allow the system to be constructed in various configurations. Support fixtures are also provided which can be used to connect the system to the wall.

20 Claims, 3 Drawing Sheets

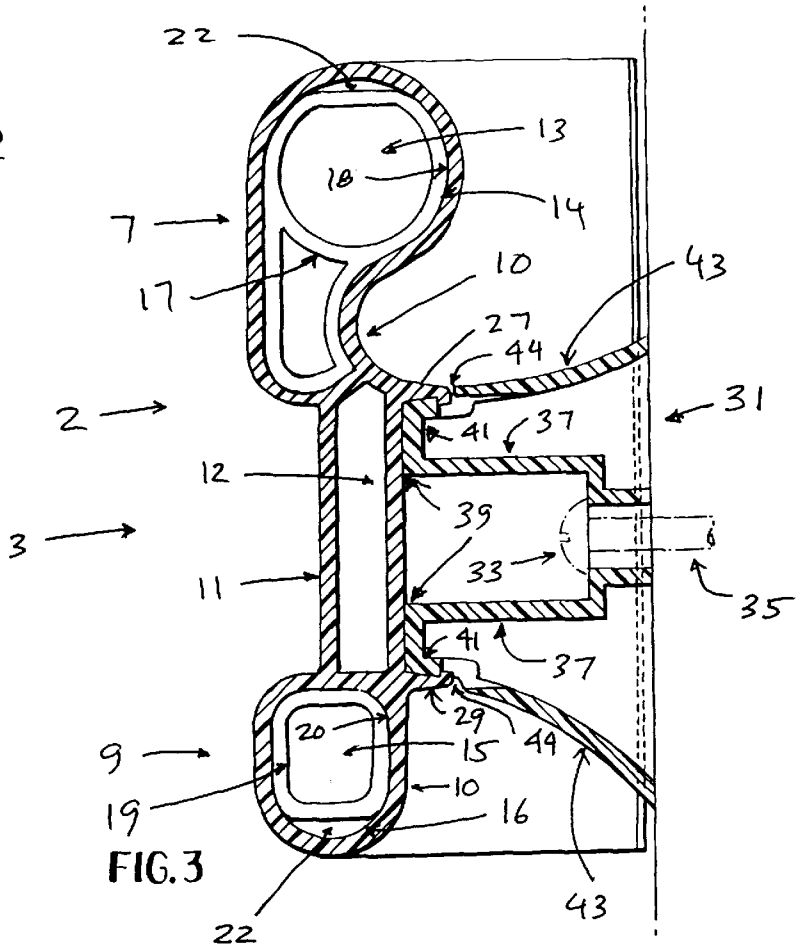
FIG. 3
FIG. 2
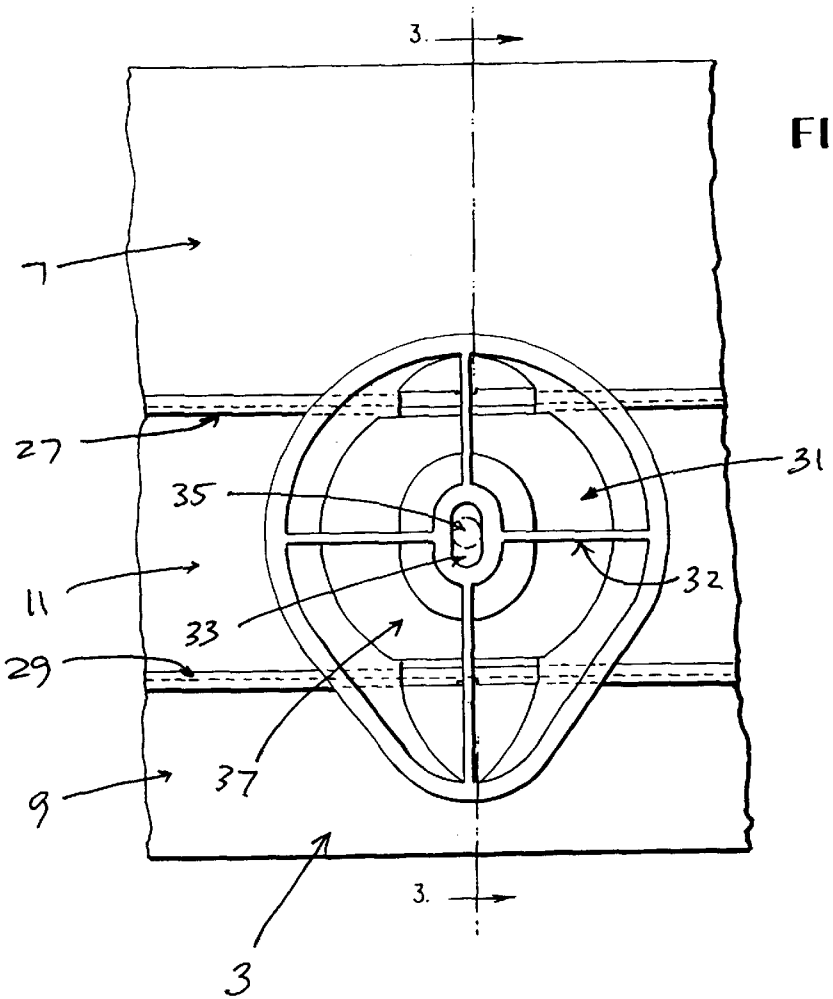

53
55
55
55

47
51
17
7
51
11
51
9
47
19
51
13
27
12
29
15
49
5
24
49
24
21
3
19
17

41
43
41
31
37
39
33

39
41
31
37

MODULAR RAILING SYSTEM

RELATED APPLICATIONS

This application claims priority to U.S. Provisional Application, Serial No. 60/116,590, filed on Jan. 20, 1999.

FIELD OF THE INVENTION

The present invention relates to the field of handrail systems, and in particular, to a modular railing system for use as a handrail or bumper rail in hospitals and the like.

BACKGROUND OF THE INVENTION

In certain types of buildings, such as hospitals, it is important to maintain a relatively clean environment. Not only is cleanliness important from the standpoint of keeping areas such as operating rooms clean, but also from the standpoint of preventing the spread of illnesses and disease. In hospitals, many patients and other individuals with illnesses, including those that are highly contagious, are likely to be present. Accordingly, the probability that harmful bacteria, germs and/or viruses, etc., can be brought in and spread to other patients, visitors and employees, is relatively high.

Indeed, certain types of illnesses can easily be transmitted by simple hand contact. For example, a cold virus can be transmitted in this manner from one individual to another, i.e., one person uses his hands to blow his nose or otherwise touch a part of his body with the cold virus on it, and then, without washing his hands, touches another area, causing the cold virus to spread. Railings and/or bumper rails, in particular, which are commonly found in hospitals, are particularly susceptible in this respect because many individuals, especially those who are aged or ill, or otherwise too weak to walk on their own, tend to grasp the nearest railings, whether on a stairway climbing or descending the stairs, or in rooms or hallways reaching for support and balance. And, as soon as they touch the railings, bacteria, germs and viruses can easily be transmitted and passed onto other individuals who come into contact with the railings, who can then pass them onto others, etc.

Attempts have been made in the past to install railings in hospitals that are covered by a separate material that can be easily cleaned. For example, handrail systems comprising a bumper made of metal or rubber, which has a separate cover, with retainer clips that snap onto the bumper, have been provided. One disadvantage of such a system is that the cover must be installed separately, and in this respect, special care must be taken to ensure that the cover is properly attached, to prevent the collection and accumulation of contaminants along the joints. These systems also typically require the railing pieces to be custom manufactured to each specific application, thereby increasing cost.

SUMMARY OF THE INVENTION

The present invention relates to a modular handrail or bumper rail system for use in hospitals and the like that can be easily installed and adapted to virtually any type of room, hallway or stairway, and provides a substantially smooth, seamless exterior surface which can be easily cleaned, and helps prevent the collection and accumulation of harmful contaminants, such as bacteria, germs and viruses, etc.

The railing system of the present invention is preferably made of a smooth impervious material, such as PVC, that has properties which are resistant to the accumulation of surface contaminants. The system is also modular so that it can be installed easily using pre-constructed sections, wherein the entire system, including the railings and supports, can be constructed from off-the shelf components, to form even complex railing shapes. Moreover, the connectors that are used to construct the system are preferably self-contained inside the system, underneath the outer surface (which is sealed), so that only the smooth, substantially seamless exterior surface is exposed for easy cleaning.

The present invention specifically comprises modular handrail (or bumper rail) sections, each having a predetermined length, which can be secured together, end-to-end, to form a continuous railing system. In the preferred embodiment, each of the handrail sections has a profile that comprises an upper railing portion and a lower railing portion connected together by a narrow flange portion. This same profile is preferably extended throughout the system such that when the sections are connected together they form a substantially consistently shaped handrail. The joints which exist between each adjacent section are preferably sealed such that the exterior surface of the handrail is substantially continuous and smooth. The exterior surface of the sections is also preferably substantially rounded to further enable the handrail exterior to be easily cleaned.

Each of the handrail sections preferably has upper and lower interior compartments having predetermined shapes that extend longitudinally therethrough inside each of the upper and lower railing portions, respectively. The interior compartments are preferably open at the ends so that upper and lower internal connectors, also having predetermined shapes, can be inserted into the upper and lower compartments to help connect the sections together. The upper and lower internal connectors are preferably shaped in a manner that allows them to fit relatively snug inside the upper and lower interior compartments, respectively. In this manner, the handrail sections can be substantially held together by friction alone, or preferably, by friction in combination with an adhesive. In this respect, multiple handrail sections can be rigidly secured together without the need of any exposed mechanical fasteners.

While the handrail sections can be made straight, they can also be curved with either an inside or outside curvature. In this manner, various handrail configurations can be provided using the same modular sections, simply by alternating the straight and curved sections in the desired patterns. The same upper and lower internal connectors, nevertheless, are preferably used to connect the curved handrail sections to the straight handrail sections, insofar as the profiles of the curved and straight sections are substantially identical. When the handrail sections are curved, however, the ends of each curved section are preferably provided with a straight portion, such that the same upper and lower internal connectors, which are also preferably straight, can be inserted into the compartments.

The handrail sections are preferably secured to a wall by one or more support members which are preferably made of the same smooth impervious material as the handrail sections. The support members are adapted to be fastened directly to the wall by internal screws or other fasteners, and preferably have one or more engaging portions located on the exterior surface onto which one or more engaging portions of the handrail sections can be positioned. The engaging portions of the handrail sections preferably comprise upper and lower retaining brackets located on the side facing the wall which allow the sections to be slidably adjusted on upper and lower retaining tabs located on the support members.

The retaining brackets and tabs (on the handrail sections and support members, respectively) are preferably relatively tight fitting, such that friction alone may be enough to hold the handrail sections in position relative to the support members, although an adhesive is preferably used to help secure the sections and members properly. They also preferably fit together such that the exterior surfaces of the sections and members are flush with one another. In this respect, the only mechanical fastener that is required by the present invention is the screw needed to secure the support members to the wall. All other connections are preferably made as discussed above, either by friction or friction in combination with an adhesive, thereby making installation relatively simple.

After the handrail sections are connected together, and secured to the wall using the support members, the system is sealed using a sealing process, such as solvent welding. In this respect, the sealing process is preferably used to seal the joints between each adjacent section and member together, to form a substantially continuous, smooth and seamless exterior surface, which can be easily cleaned and resists the collection and accumulation of harmful contaminants. An end cap can also be used to close the end of the handrail system where it terminates.

BRIEF DESCRIPTION OF THE DRAWINGS

FIG. 2 is a sectional view of the support member of the present invention used to secure the handrail system to the wall;

FIG. 3 is a cross-sectional view of the handrail system of the present invention taken through section 3—3 shown in FIG. 2;

DETAILED DESCRIPTION OF THE INVENTION

Figure 1:
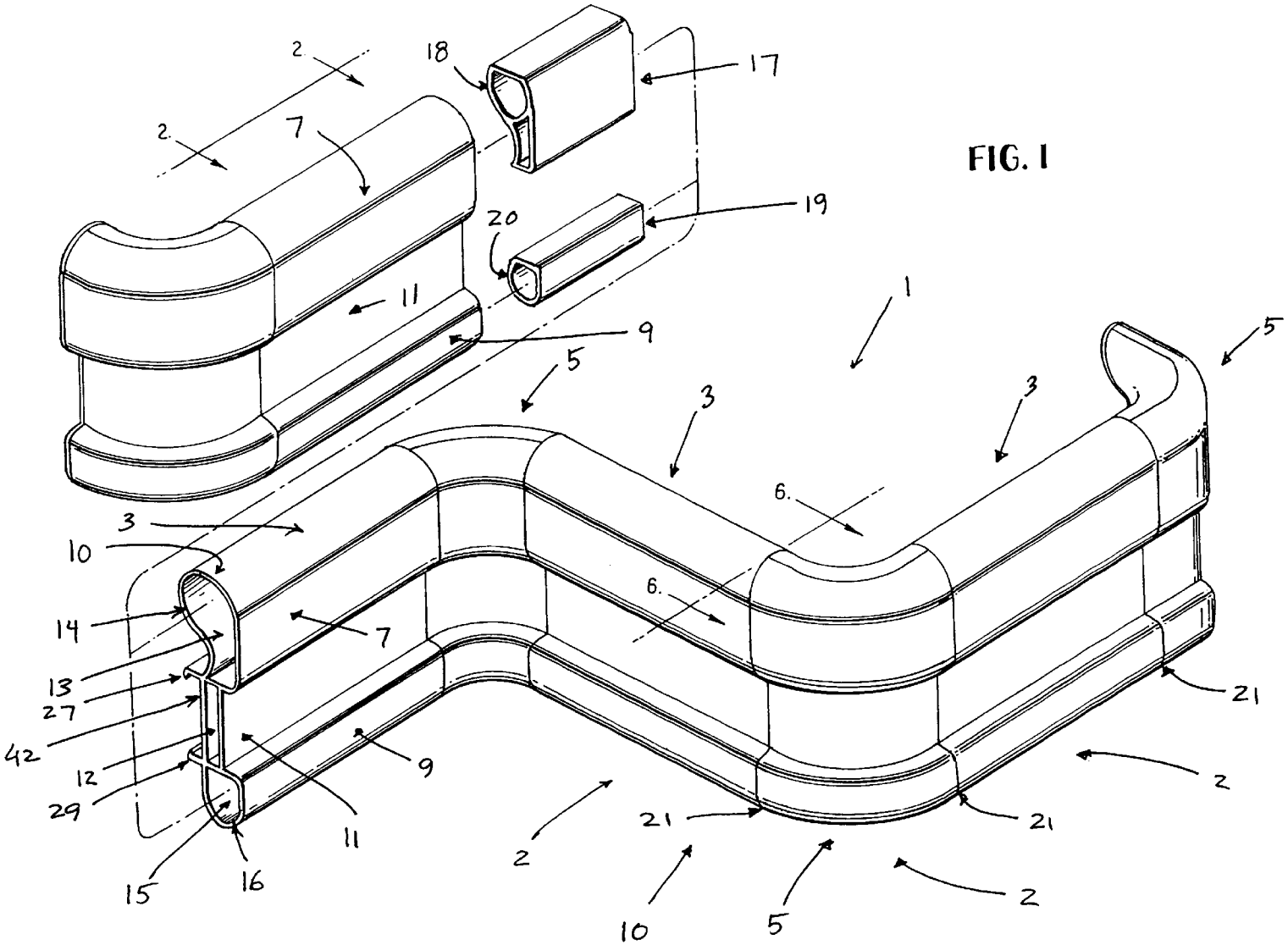
FIG. 1 is a perspective view of the handrail system of the present invention showing the handrail sections connected together by upper and lower internal connectors which can be inserted into upper and lower interior compartments.

FIG. 1 shows the handrail or bumper rail system of the present invention having multiple handrail (bumper rail) sections 2, including straight sections 3 and curved sections 5, connected together, end-to-end, to form a continuous railing structure 1. As seen in FIG. 1, each of the handrail sections is comprised of an upper railing portion 7, a lower railing portion 9, and a narrow middle flange portion 11 extending therebetween. The exterior surface 10 of each of the sections 2 is preferably made of a shell-like wall and is otherwise substantially rounded and smooth.

Figures 4, 5, 6, 7:
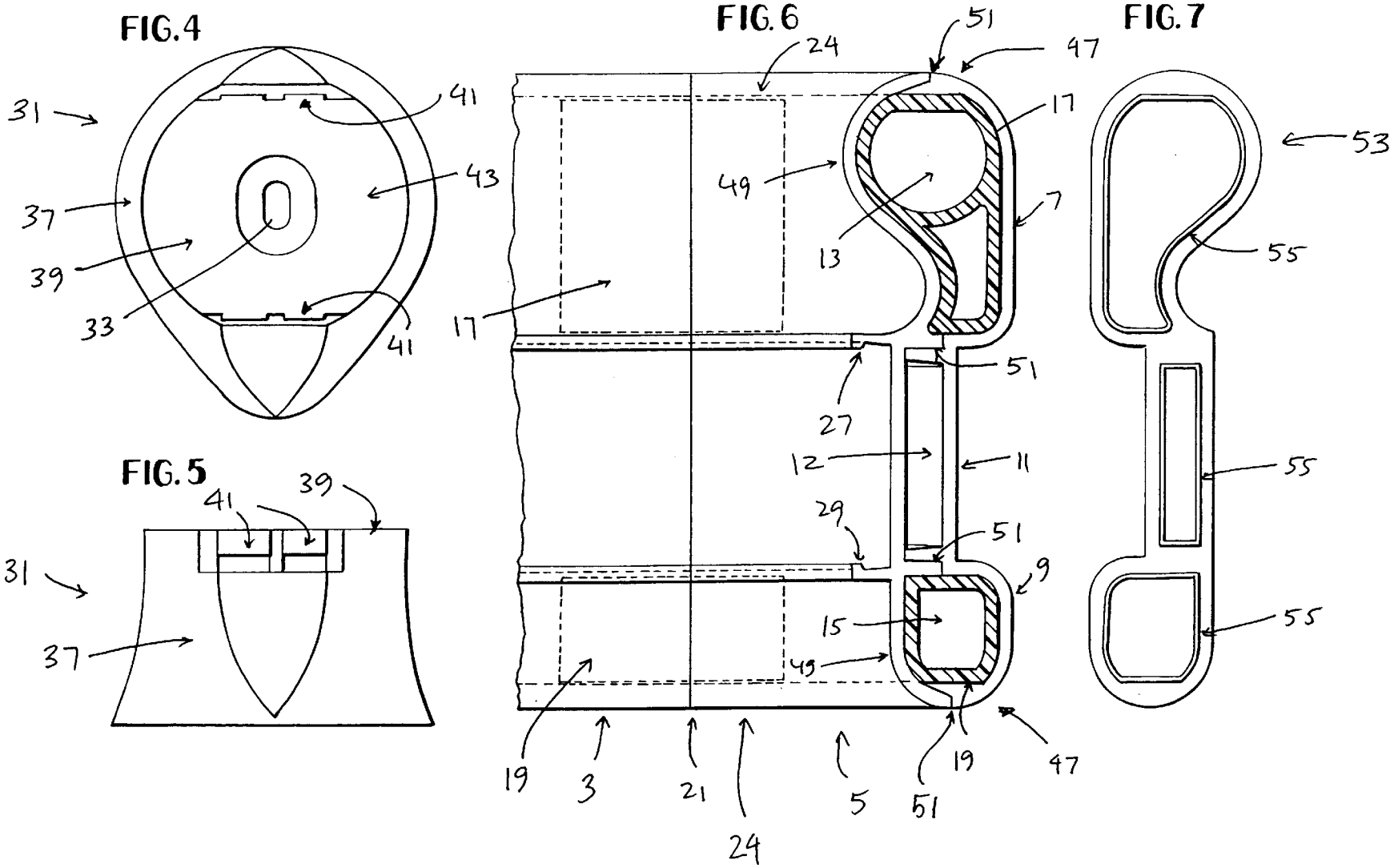
FIG. 4 is a front view of the support member of the present invention used to secure the handrail system to the wall.
FIG. 5 is a bottom view of the support member of the present invention.
FIG. 6 is a cross-sectional view of the handrail system of the present invention taken through section 6—6 shown in FIG. 1.
FIG. 7 is a side view of the end cap of the present invention.

Each of the handrail sections 2 preferably has a profile like the one shown in FIGS. 1, 3 and 6. That is, the upper railing portion 7 has an upper interior compartment 13 that extends longitudinally therethrough, and the lower railing portion 7 has a lower interior compartment 15 that extends longitudinally therethrough. The ends of each of the interior compartments, 13 and 15, are open such that when multiple handrail sections are positioned end-to-end they form continuous channels therethrough. Compartment 12, such as in flange portion 11, and other compartments, can also be provided if desired.

To connect the handrail sections 2 together, upper and lower internal connectors, 17 and 19, are provided which can be inserted into the upper and lower interior compartments, 13 and 15, respectively. As seen in FIG. 1, the upper internal connector 17 is preferably provided with an exterior profile 18 that is substantially similar to an interior profile 14 of the upper interior compartment 13. Also, the lower internal connector 19 is preferably provided with an exterior profile 20 that is substantially similar to an interior profile 16 of the lower interior compartment 15. In this manner, the upper and lower internal connectors, 17 and 19, are preferably adapted to be fitted relatively snug within the upper and lower interior compartments, 13 and 15, respectively, such that they can be substantially supported by friction, although preferably, an adhesive is also used to secure the sections together. A stop (not shown) to prevent the connectors, 17 and 19, from sliding too far into the interior compartments, 13 and 15, can be provided if desired.

While the profiles discussed above can be substantially similar in shape, they do not necessarily have to be. One or more spaces or gaps 22, such as shown in FIG. 3, for example, can be provided between the connectors and compartments. While the spaces 22 do not necessarily have to provide any function, they can provide some flexibility between the two members, which can be helpful in making it easier to insert the connectors into the compartments. In this respect, the internal connectors, 17 and 19, can also be tapered slightly to make them easier to install. The spaces 22 can also be helpful in allowing some room for expansion and contraction between the members during temperature changes. The upper and lower internal connectors, 17 and 19, as shown in FIGS. 1 and 3, can also have one or more compartments of their own, if desired.

The internal connectors, 17 and 19, enable multiple handrail sections 2 to be connected together, end-to-end, while providing rigidity to the system from one section to another. And, because the connectors, 17 and 19, are secured to the inside surface of the interior compartments, 13 and 15, the handrail system of the present invention is free of any exposed mechanical fasteners, which enables the exterior surface to be substantially continuous. Moreover, the exterior surfaces of the adjacent handrail sections 2 are preferably flush with one another, and only a small joint 21 is exposed between each adjacent section.

The joints 21 are preferably sealed using a conventional type of sealing process, such as solvent welding, which is the preferred method. Sealing the joints helps to secure the sections together to provide a substantially continuous, smooth and seamless exterior surface, from one section to another, which can be easily cleaned and is resistant to the collection and accumulation of surface contaminants.

To change the configuration of the handrail system, i.e., to conform the system to corners of rooms, ramps, hallways and stairways, etc., one or more curved handrail sections 5 can be used in conjunction with one or more straight handrail sections 3. By alternating straight and curved handrail sections in this manner, and providing handrail sections 2 that are cut to, or have, the desired lengths, the handrail system of the present invention can be made to fit virtually any desired space. While a predetermined degree of curvature can be provided which is suitable for most applications, the curvature of the curved handrail sections 5 can also be customized for any given application if needed.

Moreover, the straight and curved handrail sections, 3 and 5, can be curved upward or downward (not shown), such that the present handrail system can be extended onto ascending or descending stairway landings and corners and/or where ramps exist.

As shown in FIG. 1, the curved handrail sections 5 preferably have substantially the same profile as the straight handrail sections 3 such that they collectively form a relatively continuous and uniformly shaped railing structure 1. In order to use the same internal connectors, 17 and 19, to connect the curved sections 5 to the straight sections 3, however, the ends of each of the curved handrail sections 5 preferably have a short straight portion 24, as shown in FIG. 6, forming a straight portion of the interior compartments, 13 and 15, so that they receive and engage a straight internal connector, 17 or 19. In this respect, the connectors, 17 and 19, can be made shorter, if needed, or cut, or otherwise shifted so that the greater portion of the connectors is inserted into the straight handrail section 3, rather than the curved handrail section 5.

The handrail system of the present invention can be secured to a wall using support members 31, such as shown in FIGS. 2–5. The support members 31 are individual support fixtures which are preferably intermittently positioned at predetermined locations along the length of the handrail. The support members are capable of being fastened to the wall using any conventional fastener, such as a screw or bolt 35, which can be inserted through a center hole 33. The hole 33 is preferably elongated to allow the support member 31 to be adjusted vertically in relation to the screw 35 if desired. A single screw 35 enables the support member to rotate in relation to the screw, which can be helpful in orienting the support member properly for better connection to the railing system. The body 37 of the support member 31 preferably has an outward dimension that extends outward and positions the handrail a predetermined distance away from the wall, leaving a space between the railing and wall for easier grasping. Ribs or supports 32 can be provided within the body 37 of the support member 31 to provide rigidity.

The distal end 39 of the support member 31 preferably engages the middle flange portion 11 of the handrail section 2, as shown in FIG. 3. Preferably extending backward above and below the middle flange portion 11 on each handrail section 2 are upper and lower brackets, 27 and 29, which also extend substantially longitudinally along the length of each section. In this respect, when the sections 2 are connected together, the upper and lower brackets, 27 and 29, form a substantially continuous channel that extends along the back side of the railing.

The upper and lower brackets, 27 and 29, are spaced a predetermined distance apart and are capable of engaging corresponding upper and lower tabs 41 extending from the support member 31. In this manner, the handrail sections 2 can be secured to the support members 31 simply by pressing and snapping the upper and lower brackets onto the upper and lower tabs 41. Because the upper and lower brackets, 27 and 29, extend along the length of the railing, the railing can, if desired, be moved longitudinally in relation to the tabs 41 to adjust the position of the railing relative to the support members 31. And, because the upper and lower brackets form a continuous channel, they can engage the support member 31 even along a joint 21. In this respect, the upper and lower brackets, 27 and 29, can be extended along the curved handrail sections 5, although they do not have to be.

The friction fit between the upper and lower brackets, 27 and 29, on one hand, and the upper and lower tabs 41, on the other hand, can provide a relatively secure connection between the handrail sections 2 and support members 31. In such case, it is desirable to design the system so that one or more curved handrail sections 5 are located where they can prevent the handrail from sliding longitudinally in relation to the support members 31, i.e., such as by having two support members located on opposing perpendicular sections of the railing. Nevertheless, notwithstanding the locations of the support members, the joints 44 between the handrail sections 2 and support members 31 can, if desired, be secured using an adhesive to ensure that the joints are secure.

Also, when the handrail sections are secured to the support members 31, the exterior surfaces, 43 and 10, are, like the surfaces of the handrail sections, preferably substantially flush with one another and continuous, with only a small joint 44 between them. The same sealing process used to seal the joints 21 on the handrail sections 2 can also be used to seal the joints 44 if desired.

Each of the handrail sections 2, connectors, 17 and 19, support members 31 and end caps 53 are preferably made of a substantially rigid, smooth and impervious material, such as PVC, or other moldable and/or extrudable material, i.e., such as other types of plastic. As discussed, the material is preferably one that has properties which are resistant to the collection and accumulation of surface contaminants, such as bacteria, germs and viruses, and can be easily cleaned.

The straight handrail sections 3 and internal connectors, 17 and 19, can be extruded and manufactured using an extrusion process because of their consistent cross-sectional shapes. The curved handrail sections 5, on the other hand, as well as the support members 31, and end caps 53, are preferably manufactured using a molding process. When a molding process is used, the curved handrail sections 5 are preferably manufactured in two pieces, 47 and 49, as shown in FIG. 6, and glued together, such as along joints 51. A decorative design or pattern can be provided, if desired, on the flange portion 11 of the sections 2.

The end cap 53, shown in FIG. 7, can be provided to seal the terminating ends of each handrail structure 1. On one side, the end cap 53 has a raised portion 55 in substantially the same shape as the interior profiles, 14 and 16, of the interior compartments, 13 and 15, such that the cap can be fitted directly onto the end of any handrail section 2 and secured thereto with an adhesive. Additional raised portions can also be provided in the shape of other interior compartments 12. The other side of the end cap 53 is preferably rounded and smooth to be flush with the exterior surface of the handrail sections 2. Any particular railing structure can be terminated with either an end cap 53 and/or a curved handrail section 5.

To install the system, the support members 31 are secured to the wall using a screw 35 or other fastener through the center hole 33. The support members are positioned at predetermined locations to ensure that proper support is provided. The support members 31 can be adjusted up or down or rotated in relation to the screw for proper orientation. Once the support members 31 are properly oriented, the handrail sections 2 can be connected to the support members 31 by snapping the upper and lower brackets, 27 and 29, onto the upper and lower tabs 41, respectively, and adjusting them into position. Additional handrail sections 2 can then be connected to the attached handrail sections using internal connectors, 17 and 19. The internal connectors, 17 and 19, are preferably inserted into the interior compartments, 13 and 15, respectively, and glued to the compartments, such that they provide rigidity to the system and help connect the sections together without any exposed fasteners. And, after the sections 2 are secured together, the joints 21 between adjacent sections 2 are preferably sealed using a solvent welding process, or the like. An adhesive and seal can also be used to secure the support members 31 and handrail sections 2 together, and end caps 53 if desired.

What is claimed is:

1. A railing system for use as a handrail or bumper rail, comprising:

at least a first handrail section connected to a second handrail section, said first and second handrail sections each having an upper interior compartment and a lower interior compartment;

wherein an upper connecting member is positioned inside said upper interior compartment of said first and second handrail sections, and a lower connecting member is positioned inside said lower interior compartment of said first and second handrail sections, wherein said upper and lower connecting members help to align and secure said first and second handrail sections together; and wherein said first and second handrail sections are sealed to each other, end-to-end, to form a substantially closed system having a substantially smooth exterior surface that helps to prevent the introduction and collection of germs and bacteria thereon.

2. The railing system of claim 1, wherein the upper and lower connecting members are adapted to fit relatively snug within said upper and lower interior compartments, respectively, of said first and second handrail sections.

3. The railing system of claim 1, wherein said first and second handrail sections each have upper and lower railing portions with a flange therebetween, in which said upper and lower interior compartments are located, and wherein the exterior surface is substantially smooth and rounded to help provide easy cleaning.

4. The railing system of claim 1, wherein said first and second handrail sections each have a cross-sectional profile that is substantially the same, such that a substantially continuous exterior surface is formed by said first and second handrail sections secured together end-to-end.

5. The railing system of claim 1, wherein said first and second handrail sections are made of a moldable material, and a joint is provided between said first and second handrail sections, wherein said joint is substantially sealed using a solvent welding process.

6. The railing system of claim 1, wherein an interior surface of said upper interior compartment forms a first profile surface, and an exterior surface of said upper connecting member forms a second profile surface, wherein said first and second profile surfaces are adapted such that a gap is formed between said first and second profile surfaces.

7. The railing system of claim 6, wherein an interior surface of said lower interior compartment forms a third profile surface, and an exterior surface of said lower connecting member forms a fourth profile surface, wherein said third and fourth profile surfaces are adapted such that a second gap is formed between said third and fourth profile surfaces.

8. The railing system of claim 1, wherein an interior surface of said lower interior compartment forms a first profile surface, and an exterior surface of said lower connecting member forms a second profile surface, wherein said first and second profile surfaces are adapted such that a gap is formed between said first and second profile surfaces.

9. The railing system of claim 1, wherein at least one of said handrail sections is curved.

10. The railing system of claim 9, wherein said curved handrail section has at least one straight portion in which said upper and lower connecting members can be inserted and connected.

11. The railing system of claim 1, wherein additional handrail sections are connected to said first and second handrail sections, without any exposed mechanical fasteners, to form a substantially continuous exterior surface thereon.

12. The railing system of claim 1, wherein at least one of said handrail sections is provided with upper and lower brackets extending from one side thereof, wherein a support member capable of being secured to a wall is provided, and wherein said upper and lower brackets are adapted to be secured to said support member for supporting said system on said wall.

13. The railing system of claim 12, wherein said upper and lower brackets are positioned onto one or more extended tabs located on said support member.

14. The railing system of claim 13, wherein said upper and lower brackets extend longitudinally along said at least one of said handrail sections, and wherein said support member, and said upper and lower brackets, are adapted to allow said at least one of said handrail sections to be adjusted and moved in relation to said support member.

15. The railing system of claim 13, wherein said upper and lower brackets are adapted with surfaces that engage said support member in a substantially tight manner, such that said at least one of said handrail sections is substantially held by friction in relation to said support member.

16. A railing system for use as a handrail or bumper rail, comprising:

at least two rail members connected and sealed together, end-to-end, to form a substantially closed system;

upper and lower interior compartments extending in a longitudinal direction inside each of said rail members, wherein said upper compartment has a first interior profile, and said lower interior compartment has a second interior profile;

upper and lower connecting members substantially sealed and fitted longitudinally inside said upper and lower interior compartments, respectively, to help secure said at least two rail members together, wherein said upper connecting member has a third exterior profile, and said lower connecting member has a fourth exterior profile; and wherein said connecting members are sealed inside said interior compartments, and a first gap is formed between said first and third profiles, and a second gap is formed between said second and fourth profiles, wherein said first and second gaps enable said connecting members to be easily fitted into said interior compartments.

17. The railing system of claim 16, wherein one of said at least two rail members has either an inside or outside curvature, wherein said railing system can be altered by alternating a curved rail member with a straight rail member in a predetermined pattern.

18. The railing system of claim 16, wherein the upper and lower connecting members are adapted to fit relatively snug within the upper and lower interior compartments, respectively, and the rail members are sealed together using a solvent welding process.

19. The railing system of claim 16, wherein said rail members are connected together, without any exposed mechanical fasteners, to form a substantially continuous exterior surface thereon.

20. A railing system for use as a handrail or bumper rail, comprising:

at least first and second rail members connected and sealed together, end-to-end;

at least one interior compartment extending in a longitudinal direction inside each of said first and second rail members;

at least one connecting member substantially sealed and fitted longitudinally inside said interior compartment of said first and second rail members, to help secure said at least first and second rail members together; and wherein said at least one connecting member has an exterior profile, and said at least one interior compartment of each of said first and second rail members has an interior profile, and, wherein a gap is formed between said interior and exterior profiles to enable said at least one connecting member to be easily fitted inside said at least one interior compartment of said first and second rail members.

* * * * *